United States Patent [19]

Crane

[11] 4,394,952

[45] Jul. 26, 1983

[54] ADJUSTABLE DECK BOARD FEEDER FOR AUTOMATIC PALLET NAILING APPARATUS

[76] Inventor: Richard A. Crane, Rte. 2, Box 246A, Beaverdam, Va. 23015

[21] Appl. No.: 197,963

[22] Filed: Oct. 17, 1980

[51] Int. Cl.[3] ..... B27F 7/02

[52] U.S. Cl. ..... 227/7; 198/430; 227/45; 227/103

[58] Field of Search ..... 227/7, 45, 48, 100, 227/103, 152; 198/403, 421

[56] References Cited

U.S. PATENT DOCUMENTS

| | | | |
|---|---|---|---|
| 3,090,961 | 5/1963 | McCrae et al. | 227/45 |
| 3,195,793 | 7/1965 | Hadnagy . | |
| 3,688,965 | 9/1972 | Kellner et al. . | |
| 3,706,408 | 12/1972 | Burch . | |
| 3,755,871 | 9/1973 | Nelson, Jr. . | |
| 3,763,547 | 10/1973 | Blakeslee . | |
| 3,945,549 | 3/1976 | Colson . | |
| 3,968,560 | 7/1976 | Vial | 227/45 X |
| 4,168,566 | 9/1979 | Streckert | 227/45 X |

*Primary Examiner*—Gil Weidenfeld
*Assistant Examiner*—Fred A. Silverberg
*Attorney, Agent, or Firm*—Stevens, Davis, Miller & Mosher

[57] ABSTRACT

Disclosed is a deck board feeder which is adapted to be mounted over a conveyor conveying stringer boards to a nailing head of a pallet making machine. The deck board feeder includes a plurality of elongated spaced hoppers arranged in parallel and in a direction perpendicular to the conveyed stringers. Each hopper is adapted to receive a respective stack of deck boards and includes a board restraining device at one end thereof defining an adjustable area permitting passage of one deck board from the stack endwise out of the hopper. Each hopper also includes a driving member for pushing a deck board from the stack a predetermined distance endwise out of the hopper to a position where the end of the deck board may be nailed to an underlying stringer by the nailing head. The driving member is adjustable in position along the length of the hopper to thus accommodate boards of different lengths and the spacing of the hoppers is likewise adjustable.

31 Claims, 15 Drawing Figures

FIG. 2
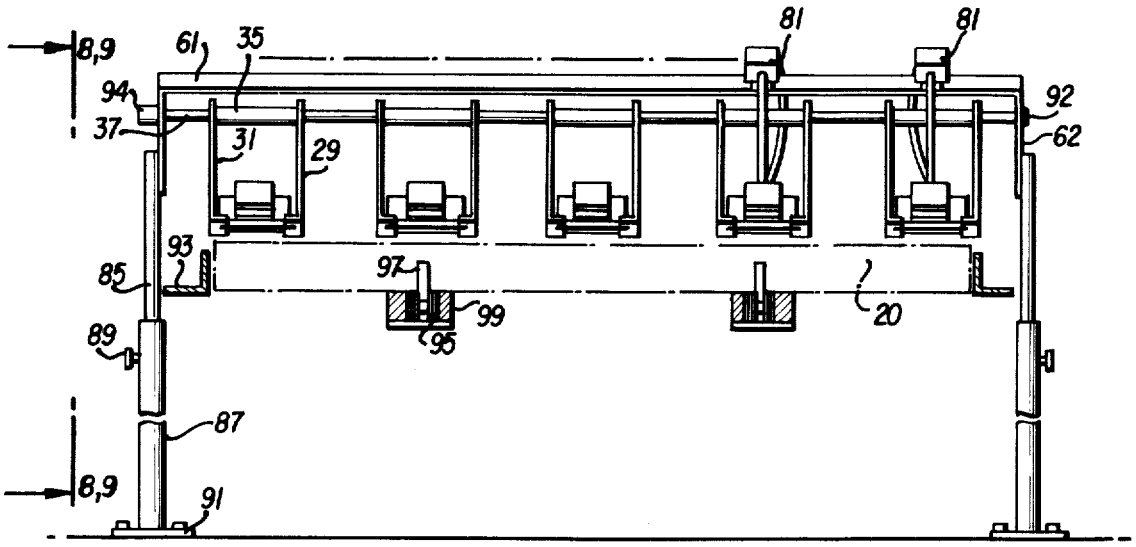
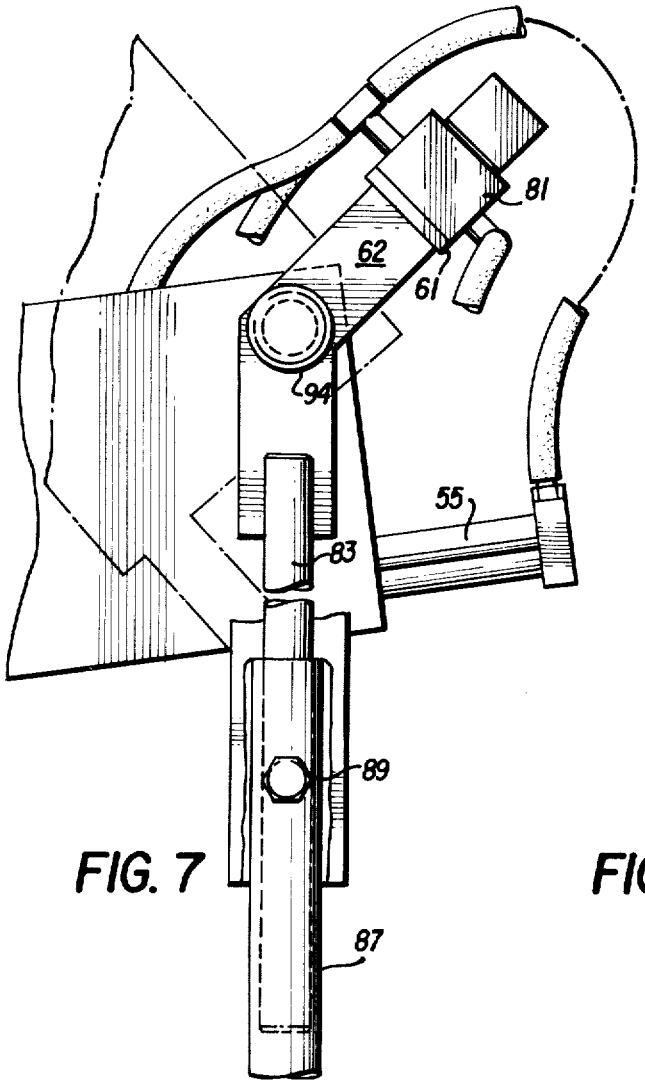
FIG. 7
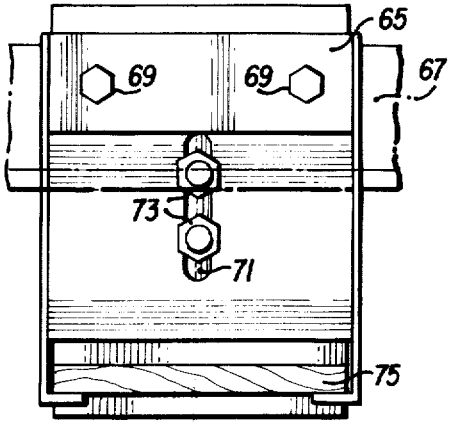
FIG. 5
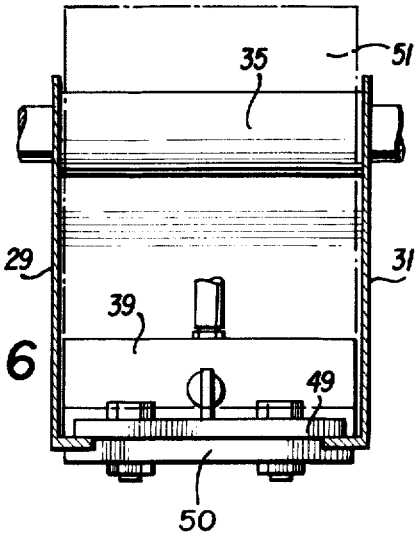
FIG. 6

ADJUSTABLE DECK BOARD FEEDER FOR AUTOMATIC PALLET NAILING APPARATUS

BACKGROUND OF THE INVENTION

The present invention relates to an apparatus for feeding deck boards to the nailing head of a pallet making machine.

Machines for making pallets by nailing deck boards to stringers are well known in the art. Conventionally, pallets can be made in various sizes and with various numbers of stringers and deck boards. The stringers are parallel to one another and one spaced a predetermined amount and the deck boards are divided into a first and second series, each series being nailed to an opposite side of the stringers. Although the nailing of the deck boards to the stringers is essentially automated once begun, it has been common practice with many nailing machines to have an operator manually feed the deck boards, and in some instances the stringers, to the nailing head. The use of operators to feed boards to the nailing head, whether they be deck boards or stringer boards, is time consuming and slows production while adding to its cost. Manual board feeding also introduces the possibility of operator error in arranging the boards under the nailing head which may cause injury to the operator, a defective pallet, or damage to the pallet being nailed.

Attempts have been made to automate the feeding of boards to the nailing head, which include automatic stringer feeding conveyors. However, even with automatic stringer feeding, a manual operation is still usually required to place the deck boards on the stringers, with the attendant disadvantages noted above. Attempts at automatically feeding the deck boards as well as the stringers to the nailing head have not been generally successful because of the rough dimensions of the lumber typically used in manufacturing pallets which makes it difficult to design a reliable deck board feeder. In one known deck board feeding arrangement, described in U.S. Pat. No. 3,706,408, a single push bar is used to simultaneously transport all of the deck boards for a pallet from a hopper to the nailing head. However, this arrangement is not entirely reliable as it can jam when the deck boards are warped as the push bar tends to ride up and over curved or warped boards.

SUMMARY OF THE INVENTION

The present invention provides a deck board feeder which eliminates the problems associated with manual feeding of the deck boards to the nailing head of a pallet making machine as well as the jamming problems associated with a single bar deck board feeder, such as illustrated in U.S. Pat. No. 3,706,408. Accordingly, one object of the invention is to provide an automatic deck board feeder which reliably transports deck boards to the nailing head of a pallet making machine, thus eliminating the requirement for operators to manually position the deck boards on the stringers. The results in a reduced labor cost as well as allowing for a completely automated higher speed production of pallets. With the deck board feeder of the invention, operators are merely required to load deck board and stringer hoppers. This can free operators for additional inspection of finished pallets to improve quality or actually result in a reduction of the total number of operators required for a pallet making machine.

An additional object of the invention is to provide an automatic deck board feeder which enables a pallet making machine to obtain an increased speed of production by eliminating the manual feeding operations and required operator activation of a nailing machine for each pallet.

An additional object of the invention is to provide a highly reliable deck board feeder which is adjustable in terms of the spacing of the deck boards, the thickness of boards which can be fed and the length thereof, thus allowing ajustment of the boarder feeder to easily accommodate boards of different dimensions to make pallets of different configurations.

An additional object of the invention is to provide a highly reliable deck board feeder which minimizes the possibility of jamming. To this end, separate board driving elements are provided in each of a plurality of hoppers respectively containing stacks of deck boards. The individual driving elements may be precisely arranged with respect to a stack of boards assuring that a deck board will be properly driven from a respective stack out of the hopper to the nailing head.

An additional object of the invention is to provide a deck board feeder which can be used alone or in tandem with respective nailing machines and which is capable of changing the pattern of fed boards from pallet to pallet or from a first series of pallet deck boards to a second series by simply altering the location and actuation pattern of individual boad driving elements. Thus, for example, the deck board feeder can be arranged to make a conventional pallet wherein the deck boards extend across all of the stringers, as well as the recently developed so called "Loc-Tite" pallet described in U.S. Pat. No. 4,184,435 in which the outer deck boards of a first series extend across all of the stringers, the interior deck boards of the first series extend across less than all of the stringers and all the deck boards of the second series on the opposite pallet side extend across all stringers.

An additional object of the invention is to provide a deck board feeder having a safety apparatus for disabling a nailing cycle of a nailing maching if one of more deck boards has not been properly fed to a nailing head.

An additional object of the invention is to provide an automatic deck board feeder which is easily mounted over a stringer conveyor associated with a nailing machine and which can be readily pivoted upwardly off the stringer conveyor to allow maintenance of the deck board feeder, the stringer conveyor, or the nailing machine, as required.

An additional object of the invention is to provide an automatic deck board feeder which is freely adjustable in height and inclination to allow for a proper mounting of the feeder over a stringer conveyor of a nailing machine.

These and other objects and advantages of the invention will become more clearly evident from the following detailed description of the invention which is provided below in conjunction with the accompanying drawings.

BRIEF DESCRIPTION OF THE DRAWINGS

FIG. 2 is a back end view of the deck board feeder of the invention;

FIG. 5 is a front view of a hopper of the deck board feeder of the invention taken along the line 5—5 in FIG. 4;

FIG. 6 is a front sectional view taken along the line 6—6 of FIG. 4;

FIG. 7 is a more detailed view of a back portion of one of the hoppers of the board feeder of the invention;

DETAILED DESCRIPTION OF THE INVENTION

Figure 1:
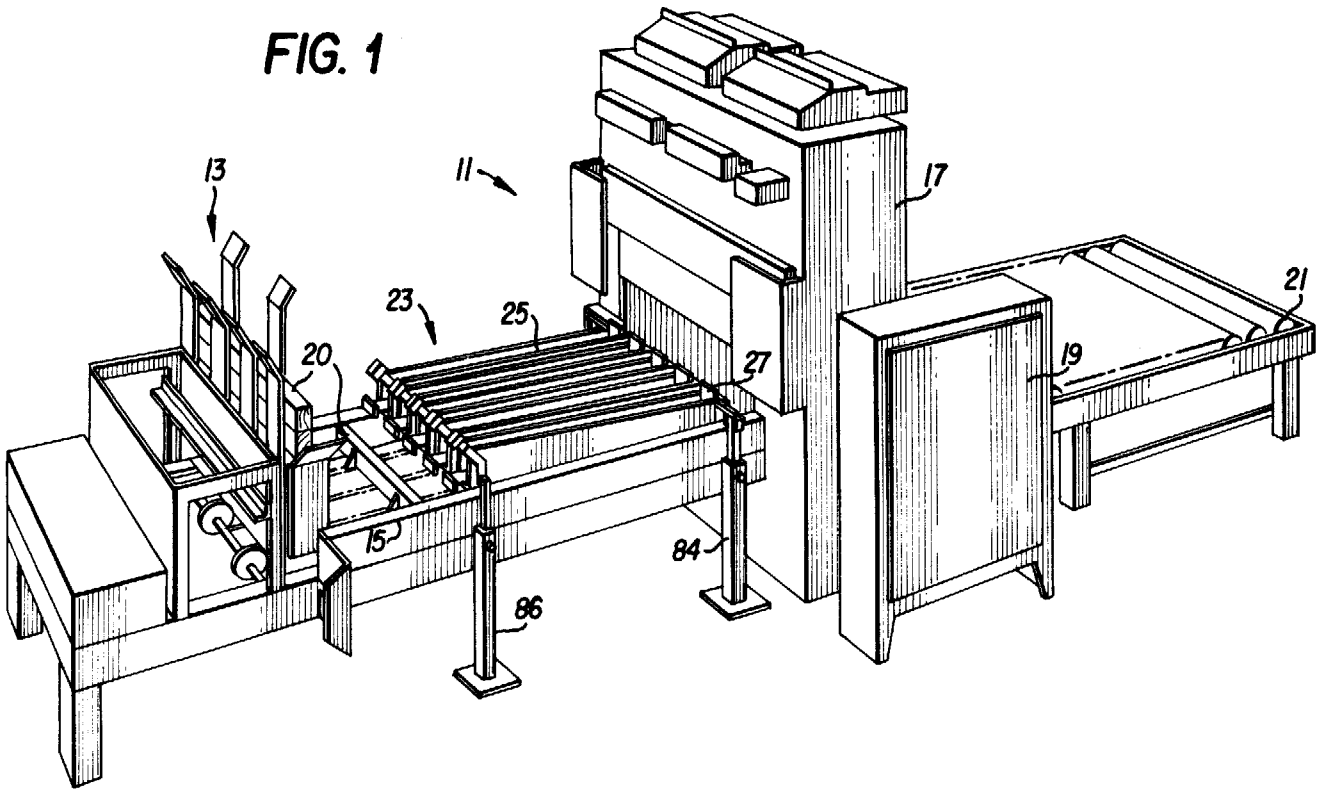
FIG. 1 is a perspective view of a conventional pallet making machine with the deck board feeder of the invention mounted thereto.
Figure 3:
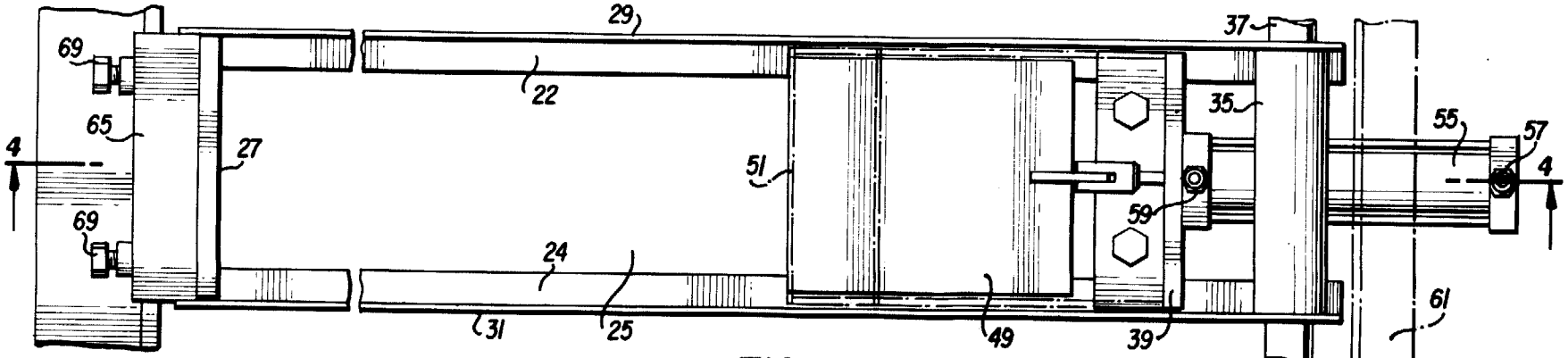
FIG. 3 is a top plan view of a hopper of the deck board feeder of the invention.
Figure 4:
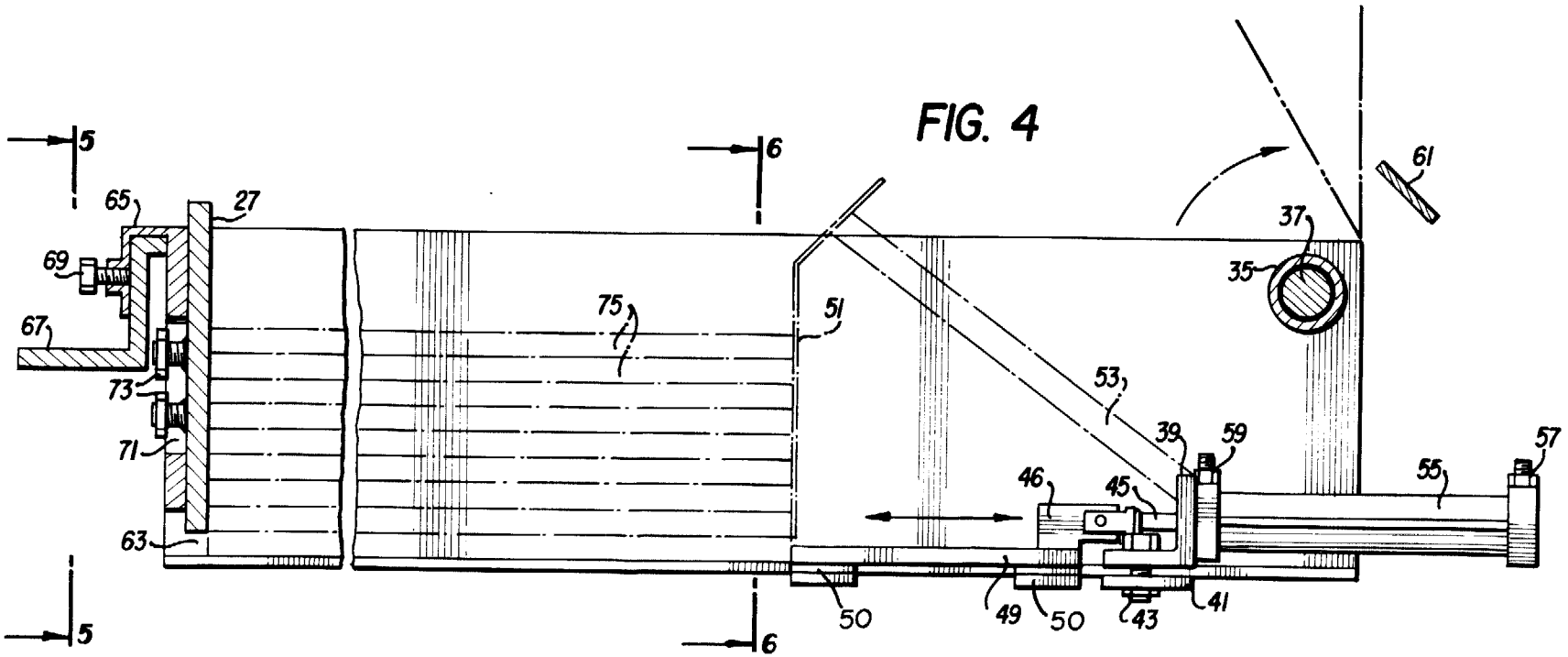
FIG. 4 is a sectional side view of a hopper of FIG. 3 taken along the lines of 4—4 in FIG. 3.

FIG. 1 illustrates a portion 11 of a conventional pallet making machine with which the present invention may be used. This machine is known in the art as the Campbell "Super-Nailer." The portion illustrated includes a stringer supply 13, a stringer conveyor 15, a nailing machine 17, a control panel 19, and an outlet feed table 21. Although a particular pallet making machine is shown, it is merely for the purposes of illustration as the deck board feeder of the invention has applicability to other pallet making machines as well.

Since the Campbell "Super-Nailer" is a well known machine, only a brief review of its principal operative features will be provided to facilitate subsequent discussion of the invention.

Stringers 20 stacked edgewide in stringer supply chute 13 are picked off one by one by a pair of endless stringer conveyor chains 95, which have spaced thereon stringer engaging push dogs 97. The push dogs 97 engage with the lowermost stringer 20 of the stack in the supply chute and transport this stringer toward the nailing machine 17. The push dogs 97 are spaced by the amount of spacing required between stringers in the finished pallet. As the stringers approach the nailing machine, a limit switch 12 (FIG. 13) sensed when a stringer is below a nailing head of the nailing machine. Activation of this limit switch causes the control circuit of the pallet making machine to stop conveying the stringers. At this point, an operator would manually place the deck boards of a first series across the stringer below the nailing head and the two subsequent stringers and then activate a switch to initiate nailing of the ends of the deck boards to a first stringer. After nailing the first stringer, the nailing machine automatically activates the stringer conveyor 15 to transport the stringer and deck boards until the next stringer is under the nailing machine. At this time, the nailer automatically nails the next stringer and activates the stringer conveyor to transport the third stringer to the nailing head. The deck boards are then nailed to the third stringer.

Figure 15:
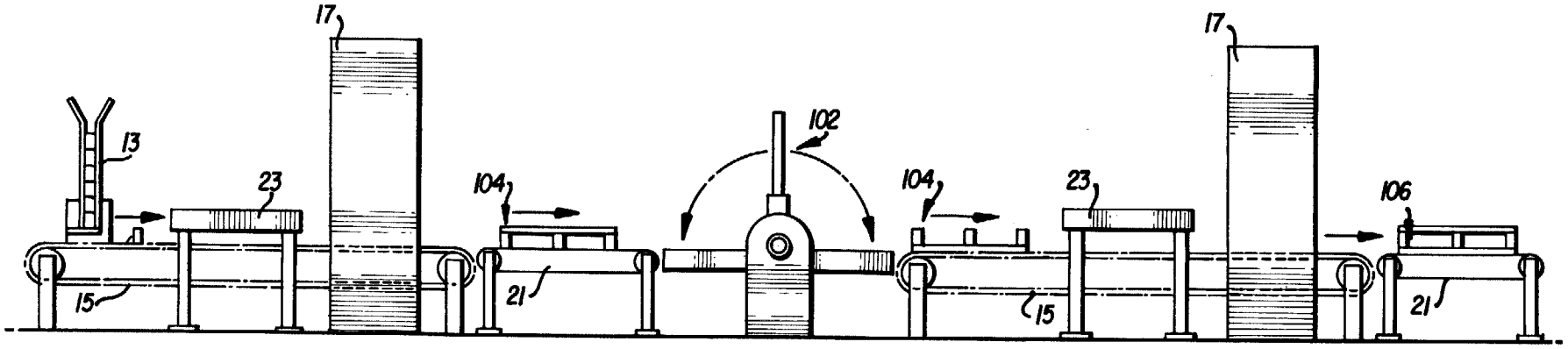
FIG. 15 is a schematic representation of a tandem pallet making machine incorporating board feeders of the invention.

After the deck boards of the first series are nailed to one side of the stringers, the nailing machine then activates the stringer conveyor 15 to transport the partially completed pallet 104 to the outlet feed table 21 which transports it to a device 102 which turns the partially completed pallet over (FIG. 15). The partially completed pallet is then transported to another portion of the pallet making machine identical to that of FIG. 1, but without the stringer supply chute 13. The partially completed pallet is thus conveyed by another stringer conveyor 15 to another nailing machine 17 for nailing of a second series of deck boards manually placed across the stringers of the partially completed pallet to complet the assembly process.

The board feeder of the invention is illustrated at 23 in FIG. 1. It mounts over the stringer conveyor 15, but does not interfere with its operation so that stringers 20 are still conveyed by the stringer conveyor 15 to the nailing machine 17 in an unimpeded manner.

The board feeder 23 includes a plurality of hoppers 25 arranged perpendicularly to the stringers being fed by the stringer conveyor 15. The hoppers are arranged in parallel and are spaced at the positions corresponding to the desired locations of the deck boards relative to the stringers in a desired pallet. The spacing between the hoppers can be adjusted to thereby adjust the deck board placement in the finished pallet as will be described in greater detail below.

Each of the hoppers 25 includes first and second L-shaped side walls 29 and 31, a front support element 65 fixed between the side walls 29 and 31 and a sleeve 35 fixed between the side walls 29 and 31 at the rear of a hopper. The sidewalls project upwardly of the hopper at their bottoms to define respective edges 22 and 24 which form a hopper bottom for supporting a stack of deck boards. The hopper front support element 65 includes an adjustment slot 71 therein. A front restraining plate 27 is positioned at the front of each hopper and includes a pair of height adjusting bolts 73 projecting therefrom through the adjustment slot 71. Respective nuts are provided on the adjustment bolts 73. The bolts may be slid longitudinally in slot 71 to allow for a vertical adjustment of the front retaining plate 27 and the nuts are tightened to fix the front restraining plate 3 at a desired adjusted position. The bottom of the front restraining plate defines a slit 63 which is a deck board outlet for the hopper. Thus, by vertically adjusting front restraining plate 27, the height of the slit 63 is adjustable to allow the hoppers to have exit outlets corresponding to the thickness deck boards stacked in the hoppers.

Each hopper may also be provided with an optional back restraining wall 51 which is supported in position by a support element 53 fixed thereto. The back restraining wall is not essential to the functioning of the hopper, but does serve to more uniformly align the deck boards lengthwise therein.

Each of the hoppers further includes a driving system for pushing the lowermost deck board of a stack through slit 63. The driving system includes a pusher plate 49 which slides along the bottom of the hopper and which engages at the foremost end thereof with the end of the lowermost deck board. The plate 49 is attached with guide pieces 50 on the bottom of the hoppers and the plate 49 and guide pieces 50 form a slot which is slidable along the edges 22 and 24 forming the bottom of the hopper, as more clearly illustrated in FIG. 6.

The pusher plate 49 reciprocates in the direction of the length of the hoppers under control of a piston rod 45 which is connected to the plate 49 through a line element 46. The piston element is part of a pneumatic cylinder 55 which extends and retracts the piston rod 45 in accordance with pressure applied to the cylinder at ports 57 and 59. When pressurized fluid is applied to port 57, the piston rod 45 extends, while it retracts when pressurized fluid is applied to port 59.

Pneumatic cylinder 55 is mounted to the bottom of a hopper by an L-shaped cylinder support element 39 fixed thereto and resting on the bottom of the hopper and a guide plate 41 positioned below the hopper. The cylinder support element 39 and guide plate 41 are interconnected by releaseable bolts 43 which when tightened squeeze support element 39 and guide plate 41 against the sidewall edges 22 and 24. Releasing the bolts allows the pneumatic cylinder to slide along the bottom of the hopper. Thus, the pneumatic cylinder is made adjustable along the length of a hopper and may be fixed in place at any position desired. This allows a corresponding positioning of the driving plate 49 so that it may be adjusted in accordance with the length of deck boards 75 placed in the hopper. The support element 53 for the back restraining wall 51 is fixed to the L-shaped cylinder support element 39 so that this too moves (if used) lengthwise of the hopper together with the pneumatic cylinder 55 during adjustment.

The number of hoppers will, of course, correspond to the number of deck boards required in a particular pallet. Hoppers can be added or deleted from the deck board feeder 23 as required for a particular pallet construction.

All of the hoppers 25 are commonly supported by a frame which includes front and back frame portions 84, 86 respectively supporting the front and back of the hoppers in common. The back support frame is made heightwise adjustable by providing on opposite sides of the stringer conveyor 15, an outer frame member 87 attached to a flat floor support plate 91. An inner frame member 85 is slidable within each outer frame member and an adjustment bolt 89 is provided on each outer frame member for locking down onto an inner frame member 85 when it is properly heightwise adjusted. Each inner frame member is in turn connected to a link member 62 which is angled rearwardly of the hoppers and the link members 62 in turn support a valve support bar 61 extending across the back ends of all of the hoppers 25. Valve support bar 61 provides a convenient point for supporting a plurality of pneumatic control valves 81 which respectively reciprocally actuate the pneumatic cylinders 55. The link members 62 define a bore through which a pivot rod 37 passes. The pivot rod also slides through the sleeves 35 of each of the hoppers and serves to hold the hoppers to the inner frame member 85. By this arrangement, the height of the rear ends of the hoppers can be commonly adjusted by adjusting the position of the inner frame members 85 relatively to the outer frame members 87. The pivot rod contains a flange 92 at one end thereof which abuts the side of one of the link members 62 and has a threaded area on the other end which is screwed with a screw cap 94 which in turn abuts the other of the link members 62. Cap 94 can easily be removed to allow partial or total removal of pivot rod 31 from the link members 62. This facilitates addition or removal of a hopper to or from the pivot rod.

The hoppers are commonly supported at their front ends by an L-shaped hopper support element 67. The support element 67 includes an opposite ends thereof U-shaped coupling elements 71 which are formed as a pair of downwardly extending plates respectively containing axially aligned holes 77. The L-shape support element 67 is adapted to rest on a pair of inner frame members 73, provided on opposite sides of the stringer conveyor 15, which are similar in function and purpose to the inner frame members 85 provided at the back of the hopper. Thus, the inner frame members 73 slide within respective outer frame members 74 to adjust the height of the L-shape support element 67 resting thereon. The holes 77 of the coupling elements 71 align with respective holes 75 provided at the end of the inner frame members 73 through which a king pin 79 is inserted to hold the support element 67 to the inner frame member 73. The king pin 79 provides a quick connect-disconnect of the support element 67 to the inner frame members 73.

Each of the hoppers is individually attached to the L-shaped hopper support element 67 by the hopper front support element 65. A pair of lock down bolts 69 are provided on each hopper front support element 65 for locking against the common hopper support element 67. Spacing of the hoppers relative to one another is easily accomplished by releasing the lock down bolts 69 which allows a sliding of the hoppers along the L-shaped support element 67 and pivot rod 37. Once the hoppers are properly positioned, the lock down bolts 69 are tighened to fix the hoppers in position relative to the support element 67. Thus, the spacing of the hopper elements and the corresponding positioning of the deck boards in the finished pallet can be easily adjusted.

As noted, the front support frame 84 also includes inner and outer frame members 73, 74 which allows a heightwise adjustment of the support element 67 and thus of the front ends of the hoppers. This adjustment together with the height adjustment for the rear ends of the hoppers by inner and outer frame members 85, 87 allows the deck board apparatus to be easily and properly positioned over a stringer conveyor 15, irrespective of irregularities in the floor or positioning of the stringer conveyor.

Figure 11:
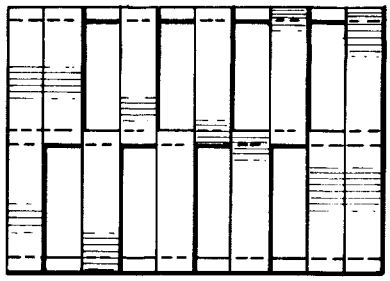
FIG. 11 is a top view of a "Loc-Tite" pallet which can be made with a board feeder of the invention.
Figure 12:
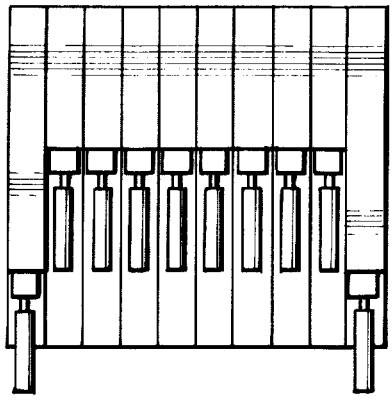
FIG. 12 is a schematic view of the board feeder of the invention configured to make the "Loc-Tite" pallet of FIG. 11.

Although the deck board feeding apparatus as shown in FIG. 1 and FIG. 5 contains five deck board hoppers with all pusher plates 49 uniformly positioned, it should be appreciated that the number of hoppers and pusher plate 49 positioning can be adjusted at will in accordance with the number of deck boards required to make any desired pallet configuration. For example, FIG. 12 illustrates the deck board feeder of the invention suitably spaced and configured to form the top of a so-called "Loc-Tite" pallet which is shown in FIG. 11. As shown, ten hoppers are used. In this type of pallet, the end deck boards have a length running across three stringers, while the intermediate deck boards have a length spanning just two stringers. As illustrated in FIG. 11, the interior deck boards alternately extend across a first and second and second and third stringers. To produce this type of pallet, ten hoppers are provided spaced adjacent one another with the pneumatic cylinders for the outer hoppers located at the end of the hoppers, and the hydraulic cylinders for the intermediate hoppers located approximately midway of the hoppers. In order to make the "Loc-Tite" pallet, the cylinders for the outer hoppers, as well as those for alternate ones of the intermediate hoppers, are first energized simultaneously to feed deck boards from their associated hoppers to the nailing machine. In this manner, the outer deck boards and every other one of the interior deck boards are first fed to a nailing head together with a first stringer. After the nailing operation is completed, the next stringer is placed in position under the nailing head by the stringer conveyor and the others of the interior hoppers are activated to place the ends of their associated deck boards over the second stringer. These deck boards are then nailed to the second stringer, following which the stringer conveyor 15 advances the third stringer to the nailing head. After nailing of the third stringer, the deck board feeder of FIG. 12 is cycled to repeat the feeding process.

Figure 8:
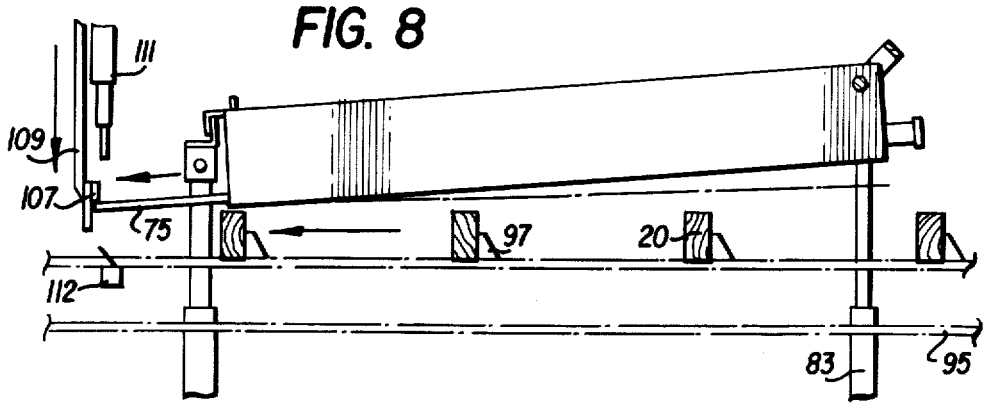
FIG. 8 is a side view of the board feeder of the invention during a portion of the sequence of a feeding and nailing operation.
Figure 9:
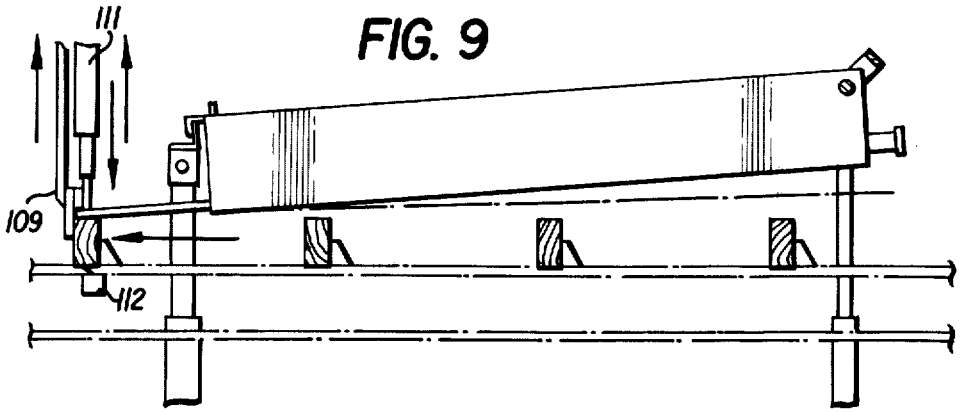
FIG. 9 is a side view similar to FIG. 8, but showing another portion of the sequence.
Figure 10:
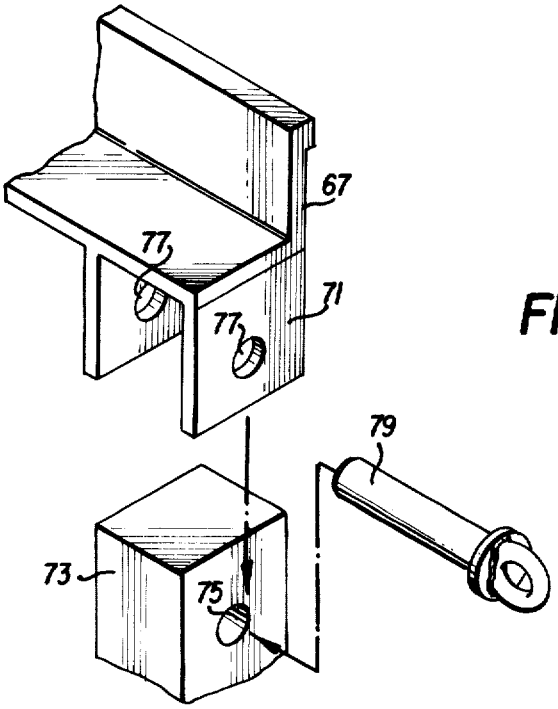
FIG. 10 is an enlarged perspective view of a releasible element which supports the fronts of all the hoppers of the board feeder.

FIG. 2 illustrates the placement of the deck board feeder relative to the stringer conveyor 15. The outer hoppers are positioned to reside over the ends of the stringers 20 while the intermediate hoppers are uniformly spaced along the length of the stringers. The stringers are pulled through the stringer conveyor 15 by the push dogs 97 attached to the conveyor chains 95. The stringers are further guided on their movement through the stringer conveyors, by lateral stringer guides 93. FIGS. 8 and 9 also show in side view the location and inclination of the hoppers relative to the conveyed stringers. The inclination of the hoppers is somewhat exaggerated in the drawings for clarity.

The deck board feeding apparatus of the invention is mounted at a location slightly upstream of a vertically reciprocating nailing head 111 of the automatic nailing machine. Associated with nailing head 111 is a guide bar 109 commonly termed a "back frame" which also reciprocates vertically. The back fence descends first and acts as a reference against which the ends of the deck boards abut, as shown in FIGS. 8 and 9. When the pneumatic cylinders for the hoppers are actuated, the deck boards are projected against the back fence 109 and remain in this position until an associated stringer is conveyed by the stringer conveyor 15 to underlie the end of the projected deck boards, as clearly shown in FIG. 9. Once a stringer underlies the end of the projecting deck boards, as sensed by a stringer limit switch 112, conventionally associated with the stringer conveyor, the nailing head is actuated and moves downward to nail the deck board ends to the underlying stringer.

After the first stringer is nailed, the back fence 109 and nailing head 111 both move upward and the nailing machine activates the stringer conveyor in conventional manner, to cause the next stringer to be positioned to underlie the nailing head 111. As this occurs, the deck boards which have been nailed to the preceding stringer are pulled halfway out of the hopper by the stringer conveyor. The second stringer of a pallet is then nailed by the reciprocating nailing head 111, and the stringer conveyor 15 is again activated by the automatic nailing machine to pull the deck boards 75 completely out of the hoppers with the ends of the deck boards now overlying the third stringer of a pallet which was conveyed to the nailing head 111. The nailing head 111 again is energized to nail the ends of the deck boards to the last stringer. The cycle is now completed and the nailing machine advances the stringer conveyor to bring the first stringer for the next pallet into position under the nailing head. The nailing machine also supplies a control signal to the deck board feeder of the invention to cause projection of the next series of deck boards.

Figure 13:
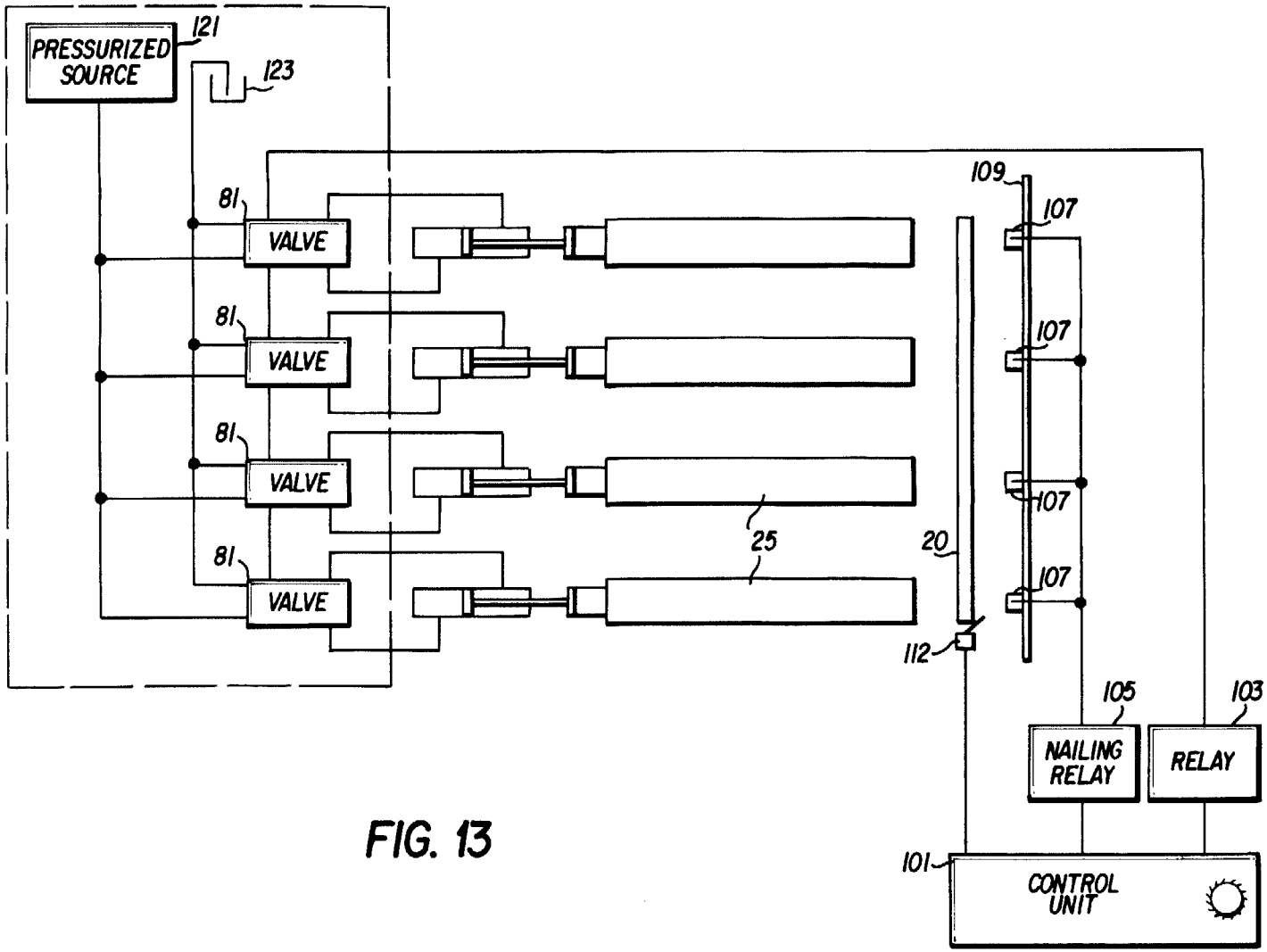
FIG. 13 is a schematic representation of the control apparatus for the board feeder of the invention.

The control apparatus for carrying out the above-described operations is schematically illustrated in FIG. 13. A control unit 101 normally associated with the nailing machine controls the sequencing of the stringer conveyor and nailing head. Since this is the normal control unit associated with the Campbell "Super-Nailer" and is otherwise a conventional piece of apparatus, a detailed description thereof is not necessary. To the conventional control unit, the present invention adds a valve control relay 103 which is provided for energizing pneumatic control valves 81, respectively associated with the pneumatic cylinders 55 for each of the hoppers. Relay 103 is energized by the control unit 101 after completion of nailing of the last stringer of a pallet. Since control unit 101 conventionally comprises a stepping switch, this control signal can be easily taken off one of the terminals in the sequence of stepping switch contacts. When control relay 103 is energized, it activates the control valves 81 causing them to supply pressurized fluid from a source 121 to the "extend" ports 57 of the pneumatic cylinders 55, causing extension of piston rods 45 and associated pushing plates 49. Upon subsequent deenergization of relay 103, the control valves 81 supply pressurized fluid to the "retract" ports 59 of the cylinders 55 causing their retraction. Since each of the control valves 81 is wired in parallel to the control relay 103, operation of the latter causes simultaneous operation of all pneumatic cylinders 55. Pressurized source 121 may be an air compressor. An air return 123 is schematically illustrated in FIG. 13 which can merely be in the form of an outlet port off each of the control valves 81. The entire pneumatic control assembly illustrated in dotted outline in FIG. 13 can be purchased as a single commercial unit from the Flow Controls Corporation as the Mark-7 multi-station pneumatic control unit. Although the invention has been described with particular reference to a pneumatic control system, it should be evident that a hydraulic or electromechanical system could also be used to move the pusher plates 69.

Figure 14:
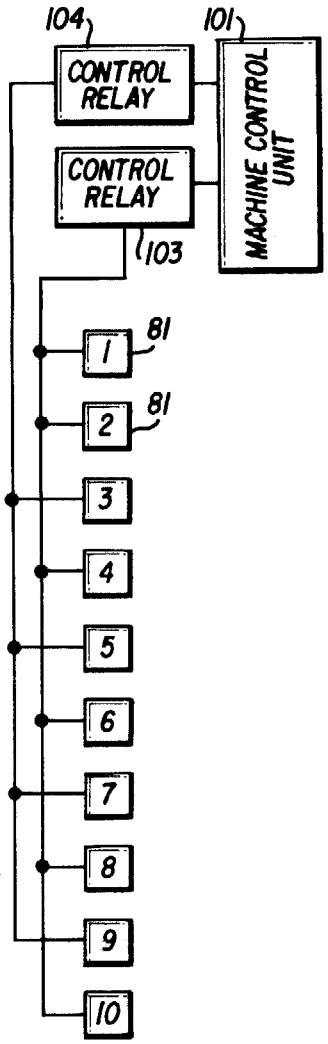
FIG. 14 shows a modification to the control apparatus of FIG. 13 used in the construction of a "Loc-Tite" pallet.

For purposes of constructing the "Loc-Tite" pallet illustrated in FIG. 11, the control valves 81 are wired such that the valve control relay 103 simultaneously actuates control valves for the end hoppers and alternate ones of the intermediate hoppers as schematically illustrated in FIG. 14. For example, designating the hoppers of FIG. 12 as 1 through 10 viewed from left to right, the control relay 103 may simultaneously energize the control valves for hoppers 1, 2, 4, 6, 8 and 10. A second valve control relay 104 may then be used to subsequently simultaneously actuate control valves for the hoppers 3, 5, 7 and 9. The two valve control relays are wired to the control unit 101 of the nailing machine such that relay 103 is first energized before nailing of the first stringer, and control relay 104 is energized after nailing of the first stringer.

FIG. 13 also illustrates a safety apparatus of the invention. A plurality of limit switches 107 are provided on the back fence 109. Each of these limit switches is adapted to sense if a board has been conveyed from an associated hopper 25 located opposite thereto. The limit switches 107 are wired in series such that if any one of the hoppers does not supply a board, the series interconnection is broken. The limit switches 107 are wired to actuate a nailing relay 103 which actuates the nailing head. Until all of the limit switches 107 are actuated, the machine will not execute a nailing cycle. Consequently, if a jamming occurs in one of the hoppers 25, or if one of the hoppers 25 is empty, the nailing machine will stop until the situation is remedied.

The deck board feeding apparatus is designed to be conveniently removable by being pivoted up and away from the stringer conveyor 15 and away from nailing head 111, when desired. Each of the hoppers of the deck board apparatus are swingable about pivot rod 37. The hoppers can be individually pivoted by releasing the lock nuts 69 to uncouple the hopper front support element 65 from the common L-shaped hopper support element 67. Alternatively, all of the hoppers can be commonly swung about pivot rod 37 by releasing the L-shaped hopper support elements 67. This is accomplished by removing the king pins 79 which fasten the coupling elements 71 of the L-shaped support element 67 to the inner frame members 73. With the removal of the king pins, the entire support element 67 and attached hoppers can be moved upwardly and the deck board feeder pivoted about pivot rod 37. The pivoting of the hoppers is illustrated in dotted outline in FIG. 7.

The sequence of operations for nailing the deck boards to the stringers is believed evident from the above description. Summarizing, the control unit 101 of the nailing machine instructs the beginning of a nailing sequence for a pallet and causes the stringer conveyor 15 to advance a first stringer of the pallet to the nailing head 111. The nailing machine also instructs the deck board feeder of the invention to feed the deck boards to the nailing head 111. This is accomplished by providing a signal to the valve control relay 103 which in turn energizes each of the pneumatic cylinders 55 causing deck board ejection. The deck boards arrive at the nailing head 111 first and abut against the back fence 109. Thereafter, the stringer conveyors conveys the first stringer in underlying fashion to the end of the deck boards. The positioning of the first stringer under the nailing head 111 is sensed by the stringer detect switch 112 and if each of the deck board sensing switches 107 indicates a deck board is properly positioned, the nailing head 111 is actuated to nails the ends of the projecting deck boards to the first stringer. Thereafter, the control unit 101 of the nailing machine operates in a conventional manner to cause the stringer conveyor 15 to advance the next stringer under the nailing head 111. This operation causes the stringer conveyor to pull the preceding stringer which now has the deck boards nailed thereto which in turn causes the deck boards to be pulled halfway out of the hoppers. When the stringer detect switch 112 causes the next stringer is in proper position, the nailing head 111 is again actuated to nail the deck boards at an intermediate position to the second stringer. Thereafter, the control unit 101 of the nailing machine again actuates the stringer conveyor 15 to cause the third stringer of a pallet to be positioned under the nailing head 111. When the third stringer is in position as sensed by the detect switch 112, the nailing head is again energized to nail what is now the ends of the deck boards to the last stringer, thus completely assembly of a pallet.

The above description has been principally provided with reference to a deck board feeder 23 mounted over a stringer conveyor 15 and feeding deck boards to a nailing machine 17 which nails deck boards to individual stringers to form a partially completed pallet. However, it should be appreciated that a partially completed pallet having a first series of deck boards already nailed to the underlying side of the stringers can also be fed by the stringer conveyor 15 under the deck board feeder 23 to the nailing machine 17 in which case the deck board feeder will supply the second series of deck boards to the nailing machine 17 for nailing to finish the pallet. Accordingly, if two nailing machines 17 and associated stringer conveyors 15 are operated in tandem, as schematically shown in FIG. 15, with the output conveyor 21 of a first nailing machine feeding a partially completed pallet 104 to the stringer conveyor 15 of a second nailing machine through a conventional pallet turning device 102, two deck board feeders will be used, one for each nailing machine. The output of the second nailing machine will be a completed pallet 106. Each of the two deck board feeders 23 may have its hoppers and pusher plates suitably arranged and operated independently of the other feeder in accordance with the deck board pattern desired for opposite sides of the completed pallet 106, thus providing considerable flexibility in pallet construction.

Although the invention has been described with reference to a particular pallet making machine, i.e. the Campbell "Super-Nailer," it should be apparent that the deck board feeder of the invention can be used with other pallet making machines and stringer conveyors. Accordingly, the above description is not to be taken as limiting of the invention as many modifications, in addition to choice of pallet making machine, can be made without departing from the spirit and scope of the invention.

What is claimed is:

1. A board feeding apparatus for feeding deck boards to a pallet nailing machine comprising:

a plurality of elongated hoppers arranged in parallel for receiving respective stacks of deck boards, each of said hoppers having a board restraining means on one end thereof defining an area permitting passage of a deck board endwise out of said one end, said plurality of hoppers being commonly supported at a rear end by means establishing a pivot about which said hoppers can rotate and at a front end by a common releasable support, said hoppers being pivotable as a unit upon raising of said releasable support;

a plurality of driving members, each respectively associated with one of said hoppers for pushing the deck board a predetermined amount endwise out of said one hopper through said area, said driving members being adjustable in position along the length of said hoppers; and, means for simultaneously moving predetermined ones of said driving members from a rest position to a position causing simultaneous pushing of bottom deck boards from the ends of predetermined ones of said hoppers, said moving means thereafter retracting said driving members to said rest position.

2. A board feeding apparatus in claim 1, wherein said restraining means is a front plate respectively provided at the ends of said hoppers, said front plate defining said area as a slit on the bottoms of said hoppers, said slit permitting the deck boards on the bottoms of said hoppers to be pushed endwise out of said hoppers.

3. A board feeding apparatus as in claim 2, wherein said front plate is adjustable to vary the height of said slit.

4. A board feeding apparatus as in claim 1, wherein each of said driving members includes a piston actuated pusher plate for engaging with an end of the deck board and pushing it out of one of said hoppers.

5. A board feeding apparatus as in claim 4, wherein each said pusher plate is slidably mounted to the bottom of a respective one of said hoppers and the rest position of said pusher plate is spaced from the restraining means of said respective one hopper by an amount sufficient to permit the stacking of the deck boards in said respective open hopper.

6. A board feeder apparatus as in claim 1, wherein the driving members for some of said hoppers are located farther from the restraining means than the driving members for the remainder of said hoppers, the restraining means of all of said hoppers being located in a common plane.

7. A board feeder apparatus as in claim 1, wherein said hoppers are arranged side by side and spaced by predetermined amounts to form a hopper array, and the driving members of the outside hoppers of said array are spaced from the restraining means by a first predetermined amount and the driving members of the inside hoppers of said array are spaced from the restraining means by a second predetermined amount, which is less than said first predetermined amount, the restraining means of all said hoppers residing in a common plane.

8. A board feeding apparatus as in claim 7, wherein said moving means simultaneously moves the driving members of said outer hoppers and every other one of the driving members of said inside hoppers, and subsequently simultaneously moves the driving members of the remaining inside hoppers.

9. A board feeding apparatus as in claim 1, wherein said hoppers are attached to said releasable support by means permitting disconnection of each of said hoppers from said releasable support.

10. A board feeding apparatus as in claim 1, wherein said moving means comprises a plurality of fluid operated valves and said driving members each comprise a fluidic driving cylinder and a board pusher plate attached thereto.

11. A board feeding apparatus as in claim 10, wherein said valves are pneumatic valves and each said cylinder is a pneumatic cylinder.

12. A board feeding apparatus as in claim 1, wherein each of said hoppers further comprises a back wall which, together with said restraining means, defines means for restraining the stack of deck boards therein at opposite longitudinal ends thereof.

13. A board feeding apparatus as in claim 1 further comprising a supporting frame for said hoppers and means for separately adjusting the height of the supporting frame at opposite ends of said hoppers from a horizontal support surface, said height adjusting means permitting adjustment of the height and inclination angle of said hoppers relative to said support surface.

14. A board feeding apparatus as in claim 1 further comprising means for sensing whether the deck boards which should have been pushed from the predetermined ones of said hoppers by said driving members are actually pushed therefrom and providing a control signal when one or more of the deck boards from the predetermined ones of said hoppers are not in fact pushed therefrom.

15. The combination of a deck board feeding apparatus and a stringer conveyor for an automatic pallet making machine:

the stringer conveyor comprising at least one endless chain carrying a plurality of spaced stringer conveying elements, each for transporting a respective stringer transversely of said chain to a nailing head position; and, the deck board feeding apparatus being mounted above said stringer conveyor and comprising a plurality of elongated hoppers arranged in parallel and lengthwise in the direction of stringer conveyance, said hoppers receiving respective stacks of deck boards, each of said hoppers having a board restraining means at one end thereof defining an area permitting passage of a deck board endwise out of said one end in the direction of stringer conveyance, a plurality of driving members each respectively associated with one of said hoppers for pushing the deck board a predetermined amount endwise out of said one hopper through said ara to said nailing head position, said driving members being adjustable in position along the length of said hoppers, and means for simultaneously moving predetermined ones of said driving members from a rest position to a position causing simultaneous pushing of bottom deck boards from the ends of predetermined ones of said hoppers to said nailing head position and thereafter returning said driving members to said rest position, said plurality of hoppers being commonly supported at a rear end by means establishing a pivot about which said hoppers can rotate and at a front end by a common releasable support, said hoppers being pivotable as a unit upon raising of said releasable support.

16. The combination of claim 15, wherein said restraining means is a front plate respectively provided at the ends of said hoppers, said front plate defining said area as a slit on the bottoms of said hoppers, said slit permitting the deck boards on the bottoms of said hoppers to be pushed endwise out of said hoppers.

17. The combination of claim 16, wherein said front plate is adjustable to vary the height of said slit.

18. The combination of claim 15, wherein each of said driving members includes a piston actuated pusher plate for engaging with an end of the deck board and pushing it out of one of said hoppers.

19. The combination of claim 18, wherein each said pusher plate is slidably mounted to the bottom of a respective one of said hoppers and the rest position of said pusher plate is spaced from the restraining means of said respective one hopper by an amount sufficient to permit the stacking of the deck boards in said respective one hopper.

20. The combination of claim 15, wherein the driving members for some of said hoppers are located farther from the restraining means than the driving members for the remainder of said hoppers, the restraining means of all of said hopers being located in a common plane.

21. The combination of claim 15, wherein said hoppers are arranged side by side and spaced by a predetermined amount to form a hopper array, and the driving members of the outside hoppers of said array are spaced from the restraining means by a first predetermined amount and the driving members of the inside hoppers of said array are spaced from the restraining means by a second predetermined amount which is less than said first predetermined amount, the restraining means of all said hoppers residing in a common plane.

22. The combination of claim 21, wherein said moving means simultaneously moves the driving members of said outer hoppers and every other one of the driving members of said inside hoppers, and subsequently simultaneously moves the driving members of the remaining inside hoppers.

23. The combination of claim 15, wherein said hoppers are attached to said releasable support by means permitting disconnection of each of said hoppers from said releasable support.

24. The combination of claim 15, wherein said moving means comprises a plurality of fluid operated valves and said driving members each comprise a fluidic driving cylinder and a board pusher plate attached thereto.

25. The combination of claim 24, wherein said valves are pneumatic valves and each said cylinder is a pneumatic cylinder.

26. The combination of claim 15, wherein each of said hoppers further comprises a back wall which together with said restraining means defines means for restraining the stack of deck boards therein on opposite longitudinal ends thereof.

27. The combination of claim 15 further comprising a supporting frame for said hoppers and means for separately adjusting the height of the supporting frame at oposite ends of said hoppers from a horizontal support surface, said height adjusting means permitting adjusment of the height and inclination angle of said hoppers relative to said support surface.

28. The combination of claim 15 further comprising means for sensing whether the deck boards which should have been pushed from the predetermined ones of said hoppers by said driving members are actually pushed therefrom and providing a control signal when one or more of the deck boards from the predetermined ones of said hoppers are not in fact pushed therefrom.

29. The combination of claim 15 further comprising means for providing controlled intermittent movement of said stringer conveyor, said conveyor movement means causing the conveying of the stringer to said nailing head position after a plurality of the deck boards have first been pushed from the predetermined ones of said hoppers to said nailing head position.

30. The combination of claim 15 further comprising a vertically reciprocating nailing head at said nailing head position for nailing together underlying stringers and the deck boards, said nailing head having a vertically reciprocating guide bar associated therewith, said deck board feeding apparatus being mounted such that the ends of the deck boards pushed from said hoppers abut against said guide bar.

31. The combination of claim 30 further comprising means for sensing whether the deck boards which should have been pushed from the predetermined ones of said hoppers by said driving members are actually pushed therefrom and providing a control signal when one or more of the deck boards from the predetermined ones of said hoppers are not in fact pushed therefrom, said sensing means being mounted on said guide bar.

* * * * *